United States Patent [19]

Brünn et al.

[11] Patent Number: 4,566,115

[45] Date of Patent: Jan. 21, 1986

[54] X-RAY DIAGNOSTIC SYSTEM FOR RADIOGRAPHS

[75] Inventors: Klaüs Brünn, Erlangen; Walter Polster, Spardorf, both of Fed. Rep. of Germany

[73] Assignee: Siemens Aktiengesellschaft, Berlin & Munich, Fed. Rep. of Germany

[21] Appl. No.: 539,430

[22] Filed: Oct. 6, 1983

Related U.S. Application Data

[63] Continuation-in-part of Ser. No. 227,467, Jun. 22, 1981, abandoned.

[30] Foreign Application Priority Data

Feb. 18, 1980 [DE] Fed. Rep. of Germany ..... 3006049

[51] Int. Cl.[4] ..... H05G 1/44

[52] U.S. Cl. ..... 378/097; 250/214 P

[58] Field of Search ..... 378/97; 250/214 P

[56] References Cited

U.S. PATENT DOCUMENTS 3,546,461 12/1970 Craig .
3,600,584 8/1971 Schneble ..... 378/97
4,053,774 10/1977 Berdahl ..... 378/97
4,214,169 7/1980 Hotta ..... 3 78/97
4,313,055 1/1982 Richter ..... 378/97

*Primary Examiner*—Alfred E. Smith
*Assistant Examiner*—T. N. Grigsby
*Attorney, Agent, or Firm*—Hill, Van Santen, Steadman & Simpson

[57] ABSTRACT

In an exemplary embodiment, an X-ray image intensifier and a camera for photographing the X-ray image intensifier-output image, an automatic exposure timer which includes an integrator for detection of the light quantity per image and a threshold value switch for shut off of the X-ray tube upon attainment of a setpoint light quantity. The threshold value switch possesses a control input for determining the switch-off threshold which is connected to a correction circuit for comparing the actual value and the setpoint value of the light quantity and which so determines the threshold that the actual value is adapted to the setpoint value. The afterglow of the X-ray image intensifier following the occurrence of a switch-off signal is thereby compensated.

1 Claim, 5 Drawing Figures

X-RAY DIAGNOSTIC SYSTEM FOR RADIOGRAPHS

This is a continuation-in-part of application Ser. No. 227,467 filed Jan. 22, 1981 and now abandoned.

BACKGROUND OF THE INVENTION

The invention relates to an X-ray diagnostic system for producing radiographs, comprising an x-ray image intensifier and a camera for photographing the X-ray image intensifier-output image as well as comprising an automatic exposure timer which exhibits an integrator for detecting the light quantity per image, and a threshold value switch for disconnecting the X-ray tube upon reaching a desired light quantity.

An X-ray diagnostic system of this type is described in the German AS No. 1 929 894 (U.S. Pat. No. 3,546,461 issued Dec. 8, 1970). This known X-ray diagnostic system serves the purpose of preparation of cine radiographs. For each individual image of a cinematographic series, the X-ray tube is switched off after reaching a predetermined light quantity, so that optimally exposed individual images are obtained.

Upon occurrence of a switch-off signal for termination of an image exposure, the light at the image intensifier output does not immediately disappear, but decays slowly because the high voltage cables are still being discharged via the X-ray tube, and the image intensifier still exhibits somewhat of an afterglow or persistence. However, the light quantity actually acting on the x-ray film thereby exceeds the specified setpoint value. The time constant for the decay behavior is not fixed, but variable; it is dependent upon the radiographic data. Therefore, the decay cannot be compensated by a simple correction circuit; i.e., by reduction of the setpoint value of the light quantity by a predetermined fixed value.

SUMMARY OF THE INVENTION

The object underlying the invention relates in producing an X-ray diagnostic system of the type initially cited in which an optimum film density is achieved, respectively, in the case of all available radiographic settings; i.e., in which the decay of the image after occurrence of a switch-off signal is taken into account.

This object is achieved in accordance with the invention in that the threshold value switch exhibits a control input for the purpose of fixing the switch-off threshold which is connected to a circuit for comparing the actual value and the nominal setpoint value of the light quantity and which fixes the threshold in such a manner that the actual value is matched to the nominal setpoint value. In the inventive X-ray diagnostic system it is possible to proceed such that, during the first image of a series, the switch-off of the X-ray tube takes place upon reaching the adjusted nominal setpoint value for the light quantity. After switch-off the image becomes overexposed because of the additional light due to the decay behavior. The additional brightness is integrated in the integrator and detected by the comparing circuit which reduces the threshold of the threshold value switch such that, during the next image, the X-ray tube is switched off sufficiently early so that the correct light quantity results due to the additional light following the switch-off.

The invention is explained in greater detail in the following on the basis of an exemplary embodiment illustrated on the accompanying drawing sheet; and other objects, features and advantages will be apparent from this detailed disclosure and from the appended claims.

DETAILED DESCRIPTION

Figure 1:
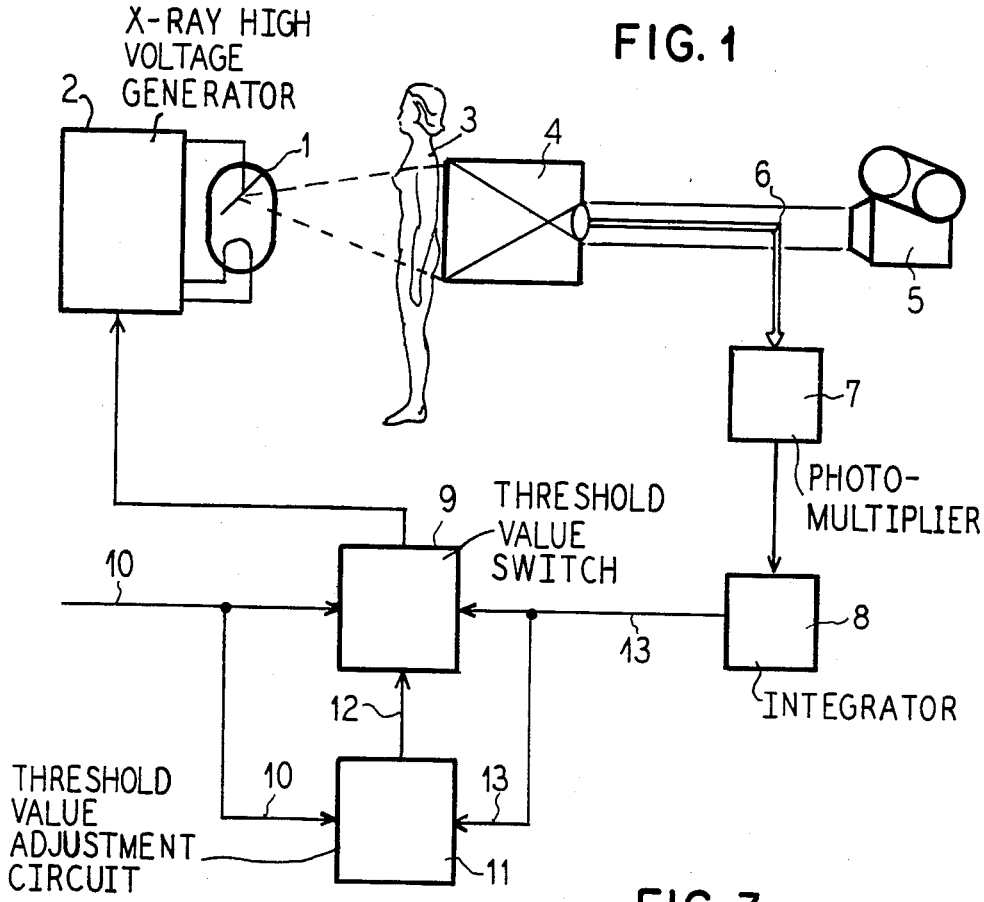
FIG. 1 is a diagrammatic view illustrating an X-ray diagnostic system in accordance with the present invention.

In FIG. 1 an X-ray tube 1 is illustrated which is supplied by an X-ray generator 2 and which irradiates a patient 3. Serving the purpose of photographing the X-ray images is an X-ray image intensifier 4, to the output fluorescent screen of which a cine film camera 5 is optically coupled. Disposed in the optical path of rays is a semitransparent mirror 6 which conveys a light signal to a photomultiplier 7. At the output of the photomultiplier 7 a signal results which is dependent upon the mean image brightness at the output luminescent screen of the X-ray image intensifier 4 and is thus dependent upon the mean image brightness on the film of the film camera 5. This signal is integrated in an integrator 8 so that there is supplied at the output of the integrator 8 a signal which corresponds to the actual value of the light quantity which acts upon the X-ray film in the case of an individual image. This signal is compared in a threshold value switch 9 with a setpoint value signal connected to the input 10. When the actual value signal attains equality with the setpoint value signal, the threshold value switch 9 effects the disconnection of the X-ray tube 1.

Connected in parallel with the threshold value switch 9 is a threshold value adjustment circuit 11 to which the setpoint value signal as well as the actual value signal for the light quantity are supplied and which compares these inputs and changes the threshold of the threshold value switch 9 via a correction signal on the line 12. As initially described, the first radiograph of a series is overexposed; i.e., due to the decay behavior, in the case of the first photograph, the signal at the input 13 of the component 11 will be greater than the signal at the input 10. Corresponding to the difference between its input signals, the component 11 varies the threshold of the threshold value switch 9 such that, in the case of the next image, upon occurrence of a shut off signal, the signal at the input 13 has not yet attained the value of the signal at the input 10, but that these two signals will only then be equal when the image at the output of the x-ray image intensifier 4 has decayed.

It will be apparent that many modifications and variations may be effected without departing from the scope of the novel concepts and teachings of the present invention.

SUPPLEMENTARY DISCUSSION

Figure 2:
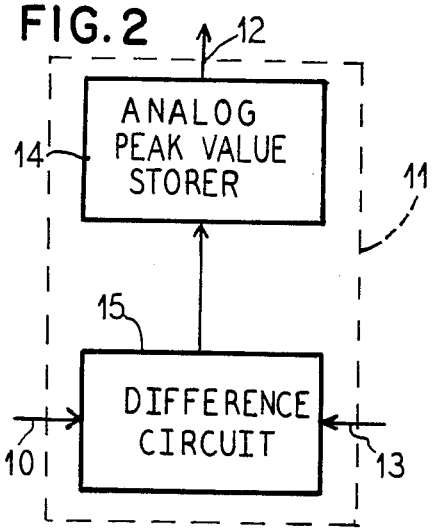
FIG. 2 illustrates a first embodiment of the threshold value adjustment circuit of FIG. 1.

It will be apparent that the component 11 of FIG. 1 may include an analog peak value storer 14, FIG. 2, for storing the peak value of the output of a circuit 15 at the end of the first exposure cycle. As soon as the X-ray tube 1 is shut off at the end of the first exposure cycle, the peak value storer may be set to zero and then connected to the output of the circuit 15 to receive a first correction value in accordance with the amount of afterglow of the image intensifier output screen. The first correction value is then stored by the peak value storer 14 and continuously supplied to control input 12 for the duration of the photographic series, so as to correct the nominal setpoint value at input 10 of the threshold value switch 9 such that the threshold value switch 9 will provide the desired exposure of the second frame and any further frames of the exposure series.

Figure 4:
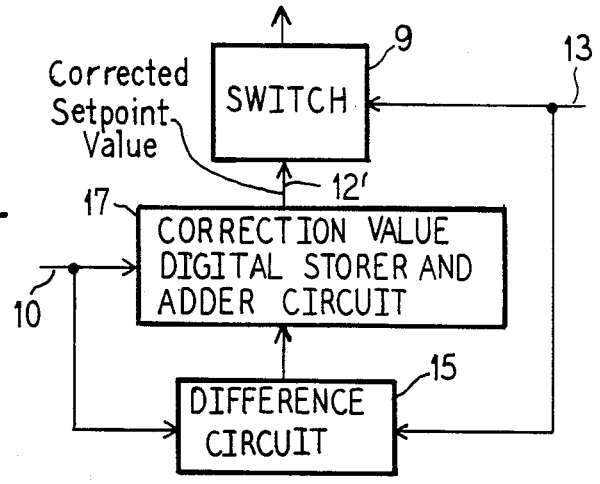
FIG. 4 shows a modification of the embodiment of FIG. 1.

Of course, the first correction value may be stored in digital form in a correction value digital storer of component 16 for use during the exposure of a second image frame, and a second order error may be read from the circuit 15 at the end of the second exposure for the purpose of digital modification of the first digital correction value. The modified correction value may be converted to analog form by a converter circuit of component 16 for use during exposure of a third image frame of the series, and so on. The digital circuitry may of course add the nominal setpoint value for switch 9 to the first digital correction value in an adder of a component 17, FIG. 4, so that actually the corrected setpoint value arrives at switch 9 entirely via a control input 12'. In this case, control input 12' would receive the nominal setpoint value from the digital circuit 17 of component 11 during the first exposure, and the first error from the difference circuit 15 of the component 11 would be converted to digital form and supplied to the digital circuitry 17 for subtraction from the digital nominal setpoint value at 10 to produce the digital corrected setpoint value which would then be converted to analog form and supplied to control input 12' during the second exposure, and so on.

DESCRIPTION OF A FURTHER EMBODIMENT (FIG. 5)

Figure 5:
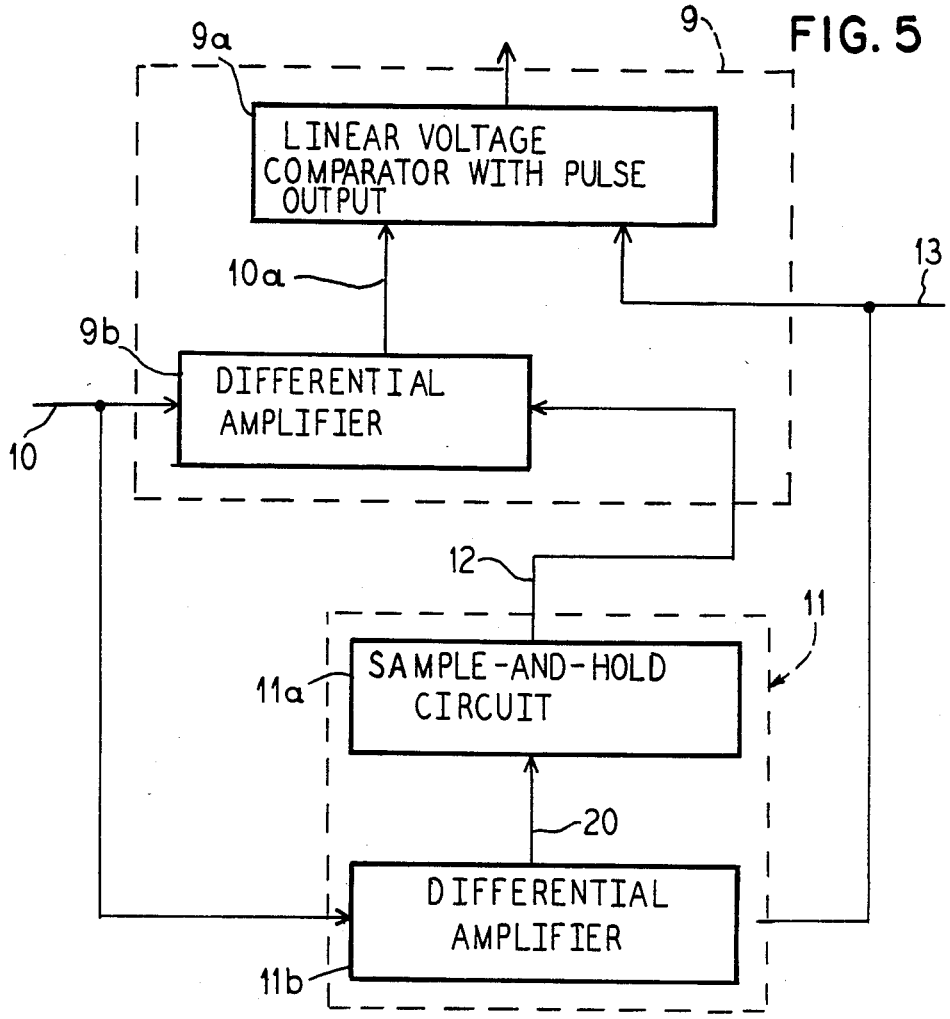

FIG. 5 is a more detailed electric circuit diagram showing an exemplary implementation of components 9 and 11 of FIG. 1.

FIG. 5 shows an example of component 11 of FIG. 1 which generally corresponds with that illustrated in FIG. 2. Thus, the difference circuit 15 is implemented as a "differential amplifier" **11*b***. Referring to the *McGraw-Hill Dictionary of Scientific and Technical Terms,* 1974, page 408, "differential amplifier" is defined as follows referring to the field of electronics (ELECTR):

"differential amplifier (ELECTR) An amplifier whose output is proportional to the difference between the voltages applied to its two inputs. Also called difference amplifier."

As previously described, when switch 9 is actuated to terminate the first exposure, there will be an afterglow supplied to the film of camera 5, so that the light quantity actually acting on the photographic film will exceed the setpoint value at input line 10. This afterglow will produce an increase in the output from integrator 8 at line 13 after the first exposure, the peak value of this integrator output exceeding the setpoint value 10 by an amount which is a measure of the afterglow to be corrected for. As indicated in FIG. 5, this measure of afterglow will be supplied at output line 20 from differential amplifier **11*b*, and will reach a peak value a short time after the termination of the exposure. This peak value at output 20 is shown in FIG. 5 as being stored in a "Sample and Hold Circuit 11*a***". In the *McGraw-Hill Dictionary of Scientific and Technical Terms,* 1974, a "sample-and-hold circuit" is defined as follows:

"sample-and-hold circuit (ELECTR) A circuit that measures an input signal at a series of definite points in time, and whose output remains constant at a value corresponding to the most recent measurement until the next measurement is made."

In FIG. 5, threshold value switch 9 is shown as being implemented with a differential amplifier **9*b* and a linear comparator 9*a***. A "linear comparator" is defined in the *McGraw-Hill Dictionary of Scientific and Technical Terms,* 1974, as follows:

"linear comparator (ELECTR) A comparator circuit which operates on continuous, or nondiscrete, waveforms. Also known as continuous comparator.⇄

By way of example, a linear comparator which supplies a pulse output waveform is illustrated in the first figure at page 359 of Volume 3 of the *McGraw-Hill Encyclopedia of Science and Technology,* 1971.

In operation of FIG. 5 is as follows:

During the first radiograph, the sample-and-hold circuit **11*a* of component 11 is empty so that the signal on line 12 is zero. The comparator 9*a* of component 9 accordingly receives on the line 13 the signal corresponding to the respective light quantity, while on the line 10*a*, comparator 9*a* receives the setpoint signal value which is also present on input line 10. When the signal on the line 13 reaches the level of the signal on line 10*a*, then comparator 9*a* effects the disconnection of the X-ray tube 1. After a lapse of a certain time after the termination of the first radiograph, after which the light on the image intensifier output has decayed, the signal on line 20 at the output of differential amplifier 11*b* is stored in the sample-and-hold circuit 11*a*. This storage effects a radiographic control on subsequent exposures. In the case of the following radiographic exposure there is now connected on the line 12 a signal which corresponds to the difference between the setpoint value signal on input line 10 and the actually attained light quantity as a result of the first radiographic exposure as supplied by input line 13. The signal at line 12 is subtracted in the differential amplifier 9*b* from the signal on input line 10 so that the signal on line 10*a* is lower than the signal on the line 10 in accordance with the difference between the light quantity actually attained during the preceeding radiograph and the desired light quantity at input 10. When in the second radiographic exposure, the signal on line 13 reaches the reduced signal level of line 10*a*, then again the disconnection of the X-ray tube by the comparator 9*a* takes place. Upon disconnection, the value stored in the sample-and-hold circuit 11*a* can be corrected in case there is a second order error signal supplied at output 20 of the differential amplifier 11*b*** after the second radiographic exposure. With the following radiographic exposure, the above described operation is then repeated.

DISCUSSION OF TERMINOLOGY

As described in Volume 3 of the McGraw-Hill Encyclopedia of Science and Technology, 1971, page 360, comparators may take many forms and can find many uses. "For example, the electronically regulated dc voltage supply uses a circuit which compares the dc output voltage with a fixed reference level. The resulting difference signal controls an amplifier which in turn changes the output to the desired level. In a radio receiver the automatic gain control circuit may be thought of broadly as a comparator; it measures the short term average of the signal at the output of the detector, compares this output with a desired bias level on the radio-frequency amplifier stages, and changes that bias to maintain a constant average level output from the detector." It is thus apparent that one skilled in the art would understand that component 11 would include a difference circuit for obtaining the difference between the input signals.

Figure 3:
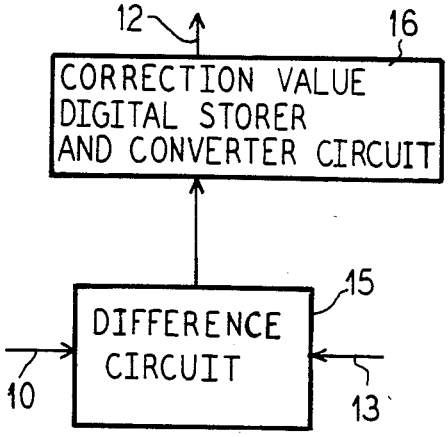
FIG. 3 illustrates a second embodiment of the threshold value adjustment circuit of FIG. 1.

The terminology "threshold value element" is utilized in U.S. Pat. No. 4,097,741 with respect to component 17 of FIG. 3, for example. Thus, at a column 4 of U.S. Pat. No. 4,097,741, beginning at line 45, it is stated: "This signal is fed to one input of a threshold value element 17 which acts as a comparator. A signal connected to the other input 18 which represents the nominal value for the transparency of the patient 2 which is to be expected in view of the organ-related key which has been actuated. The output signal of comparison component 17 is fed to X-ray generator 4 as shown in FIG. 1." As stated at column 3 of U.S. Pat. No. 4,097,741 beginning at line 60, "Comparator 17 compares the signals on its input lines 16 and 18 and delivers a switch-off signal to generator 4 if the difference or the quotient of these two input signals does not fall into a predetermined value range; . . . " The following commercially available components can be used for the electric circuit of FIG. 5:

linear voltage comparator 9*a:* LM 311 (National Semiconductors)

differential amplifiers 9*b,* 11*b:* μA 741 C (Texas Instruments)

sample-and-hold circuit 11*a:* AD 7510 (Analog Devices)

We claim as our invention:

1. An X-ray diagnostic system for radiography, comprising an X-ray tube, an X-ray intensifier coupled with said X-ray tube for receiving an X-ray image and for supplying an intensified optical output image in accordance therewith, and a camera for photographing the X-ray image intensifier—optical output image, an automatic exposure timer which includes light sensing means for the detection of the optical output image, and an integrator connected with the output of the light sensing means for forming an integration signal in accordance with the light quantity per optical output image for the X-ray image intensifier, and a threshold means connected to the X-ray tube for switching off the X-ray tube, the threshold means having a control input for receiving a switch-off control signal for controlling when the X-ray tube is to be switched-off, and correction means having an input connected with the integrator for receiving the integration signal representing the actual value of the light quantity per output optical image and having an input means for receiving a set point value representing a desired light quantity per optical output image, and having an output coupled with said control input which so determines the switch-off operation of said threshold means with respect to said integration signal that the X-ray tube is switched off by said threshold means before the integration signal reaches a value corresponding to the set point value representing the desired light quantity per optical output image, so that the actual value of the light quantity per optical output image is matched to the set point value in spite of a substantial persistence in the optical output image of said image intensifier.

* * * * *